United States Patent [19]

Collister, Jr

[11] 4,279,108

[45] Jul. 21, 1981

[54] JOINT CONSTRUCTION FOR LOG BUILDINGS

[76] Inventor: Richard L. Collister, Jr, 1114 Margaret St., Missoula, Mont. 59801

[21] Appl. No.: 60,695

[22] Filed: Jul. 25, 1979

[51] Int. Cl.[3] ..... E04B 1/10

[52] U.S. Cl. ..... 52/233; 52/286; 52/403; 52/595

[58] Field of Search ..... 52/233, 595, 284–286, 52/403; 403/380, 382, 401, 402, 403

[56] References Cited

U.S. PATENT DOCUMENTS

| | | | |
|---|---|---|---|
| 2,040,110 | 5/1936 | Tahvonen et al. | 52/233 |
| 3,189,950 | 6/1965 | Johnson | 52/286 |
| 4,154,036 | 5/1979 | Moss et al. | 52/233 |

FOREIGN PATENT DOCUMENTS

| | | | |
|---|---|---|---|
| 763144 | 7/1967 | Canada | 52/233 |
| 783292 | 4/1968 | Canada | 52/233 |
| 918882 | 1/1973 | Canada | 52/233 |
| 42819 | 5/1926 | Norway | 52/595 |
| 1338575 | 11/1973 | United Kingdom | 52/233 |

*Primary Examiner*—James L. Ridgill, Jr

*Attorney, Agent, or Firm*—Sughrue, Mion, Zinn, Macpeak & Seas

[57] ABSTRACT

Each log is provided with a tongue on the upper surface and a rectilinear groove in the lower surface thereof. The edges of the tongue are beveled so that upon insertion into a rectilinear groove elongated expansion chambers will be defined to halt the propogation of drafts between the mating surfaces of adjacent log courses. A check groove is provided at the bottom of each groove in the bottom of the log for the purpose of releasing tension in the log as it dries while the top surfaces of the log are completely free of grooves to prevent any accumulation of moisture or dirt which would lead to early decay. The corner joints have a truncated triangular configuration with the tongue portion of one log extending into the tongue portion of the other log so that the actual joint is surrounded and protected from the weather by the raised tongues on the top of the logs. A pair of vertical slots are formed in the end of one log which intersect the beveled edges of the tongue thereon and aligned vertical slots are located in the base of the recess formed in the other log. A pair of weather deflectors are inserted into each complimentary pair of slots to further seal the corner joint. A pair of compressable foam gasket strips extend along the top of each tongue and engage the corresponding gasket strips on the top of the intersecting log at the joint. A corrugated metal fastener is driven into the base of the main groove on the bottom of each log at a joint location to block off the check groove. The corrugated metal fastener will be aligned with a foam gasket to prevent the entry of air or moisture along the check groove at a corner joint. The ends of the logs at each butt joint are also provided with pairs of complimentary vertical grooves for the reception of vertical weather deflector strips and a pair of vertical recesses are disposed inwardly of each pair for the reception of foam gasket strips so that the end surfaces of the two logs will not be prevented from abutting each other.

7 Claims, 7 Drawing Figures

FIG. 4
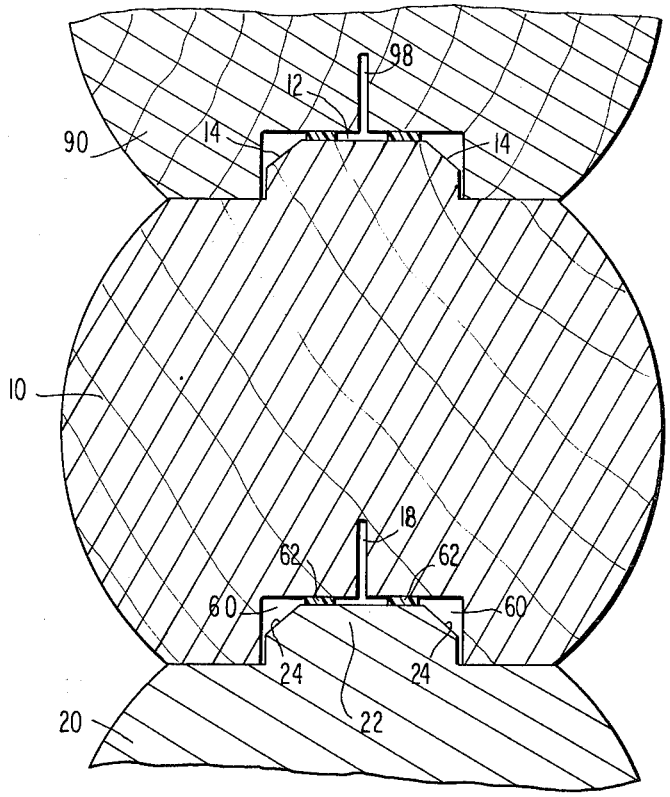
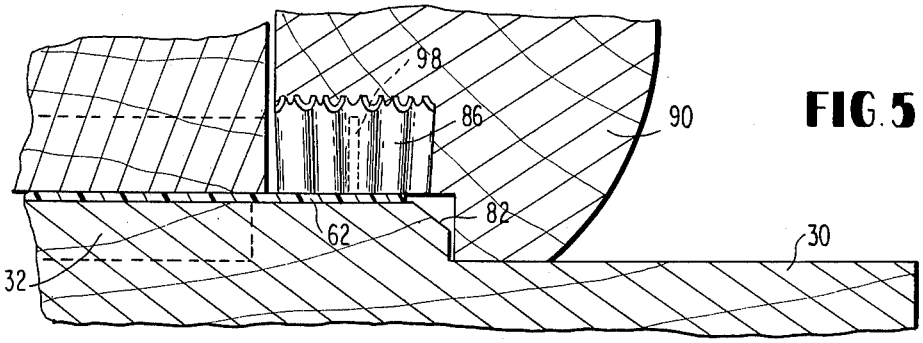
FIG. 5
FIG. 6
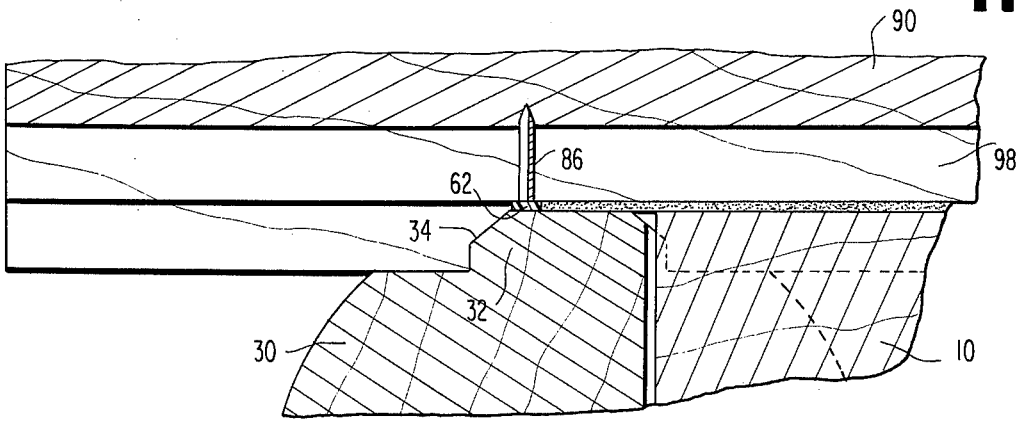

JOINT CONSTRUCTION FOR LOG BUILDINGS

BACKGROUND OF THE INVENTION

1. Field of the Invention

The present invention is directed to log buildings and more specifically with respect to new and improved joint constructions including corner joints, butt joints and tongue and groove joints between adjacent courses of logs.

2. Prior Art

The use of tongue and groove constructions between adjacent courses of logs is old and well known in the art. However, such constructions invariably have at least one groove formed in the upper surface of the log. Such a groove will be susceptible to the accumulation of moisture and dirt which will lead to an early decay of the log. The use of parallel gasket strips on the upper surfaces of logs and between the ends of adjacent logs at a butt joint is also old and well known in the art. However, the accumulated total thickness of such foam gaskets can vary the vertical and horizontal dimensions of a wall beyond acceptable tolerances, especially in the vertical dimension as the gasket material is further compressed with the passage of time due to the weight of the logs.

The use of interlocking corner joints is also old and well known in the art but the upper surfaces of the intersecting logs are either flat at the joint location or else the tongues on the upper surfaces do not physically intersect in a manner which enhances the weather tightness of the joint. Those prior art constructions utilizing tongue and groove constructions on the upper and lower surfaces of the logs do not provide for air expansion chambers but either try to achieve very close tolerances between the tongue and groove or else fill any gaps between the tongue and groove with gasket material or caulking.

While the use of expansion joints or check grooves are old and well known in the art, such grooves provide a built-in entry at corner joints for air, moisture, dirt and insects and must be laboriously filled with caulking compound adjacent each joint subsequent to the construction of the building.

The foregoing and other constructional features of log buildings all present serious drawbacks to the widespread acceptance of log buildings and the correction or prevention of certain problems arising from such constructions usually require an increase in the time and cost of erecting a log building.

SUMMARY OF THE INVENTION

The present invention provides a new and improved log building construction which overcomes the problems of the prior art joints in log building constructions by new joint designs which minimize the possibility of infiltration and decay while still providing easy and economical construction.

The present invention provides a new and improved log building construction having a weather tight, self-aligning tongue and groove construction having air expansion chambers associated therewith which will interrupt the propagation of drafts due to gaps between adjacent courses of logs.

The present invention provides a new and improved corner joint construction for log buildings wherein the actual joint is surrounded and thereby protected from the weather by the tongues on the tops of the logs. A pair of vertical weather deflectors are located at each corner joint to protect the vertical joints from water infiltration by directing such water away from the primary seal between the logs.

The present invention provides a new and improved log building construction wherein the combination of gasket material, thickness, density, resiliency and location and proper log geometry are such that the weight of the logs will compress the gasket material within predetermined limits to ensure a tight joint as the logs shrink thereby obviating the need for any recaulking or weather stripping of the joints as the building ages and will maintain the vertical dimension of the building wall within acceptable limits. The gaskets are so located at a corner construction as to provide a continuous seal while not being directly exposed to the weather and the gaskets on the upper surface of the logs extend continuously into vertical recesses at the butt joints to provide a continuous seal without adversely effecting the longitudinal dimension of a building wall. The gasket material between adjacent courses of logs is always located on top of the tongue so that the tongue and groove joint design will in itself form a barrier to keep the weather from getting to the actual gasket.

The present invention provides a new and improved log building construction wherein no grooves whatsoever are provided on the upper surface of the log which would tend to accumulate moisture or dirt and lead to early decay. A check groove is provided in the bottom of the groove on the undersurface of the log for the purpose of releasing tension in the log as it dries so that the logs will fit more easily together as they dry. A stop means is located in each check groove adjacent a corner joint which will be aligned with the gasket on top of a lower log at the corner joint to prevent the infiltration of moisture and insects along the length of the check groove.

The foregoing and other objects, features and advantages of the invention will be apparent from the following more particular description of a preferred embodiment of the invention as illustrated in the accompanying drawings.

BRIEF DESCRIPTION OF THE DRAWINGS

FIG. 4 is a sectional view taken along the line 4—4 in FIG. 2.

FIG. 5 is a sectional view taken along the line 5—5 in FIG. 2.

FIG. 6 is a sectional view taken along the line 6—6 in FIG. 2.

DETAILED DESCRIPTION OF THE INVENTION

Figure 1:
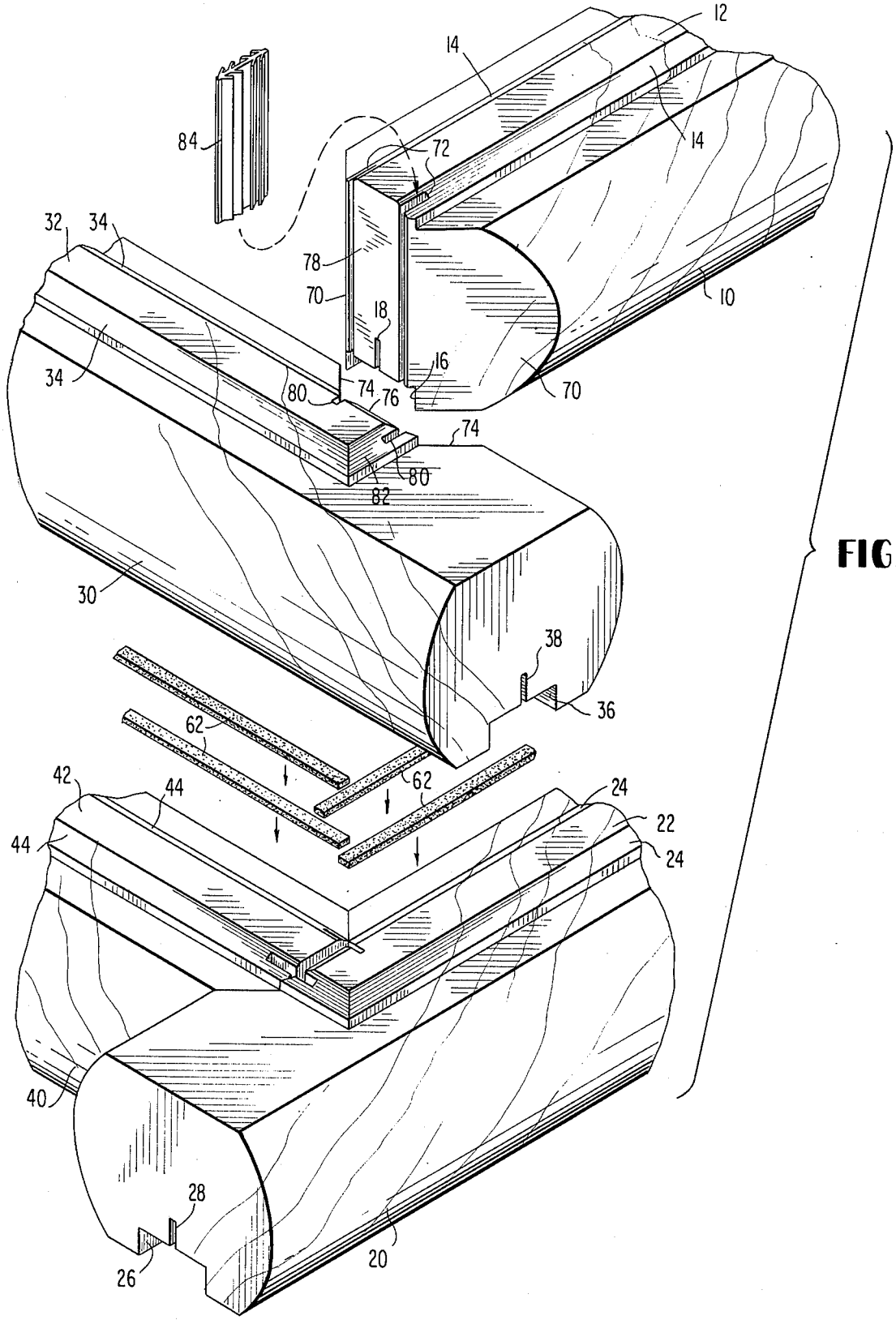
FIG. 1 is an exploded perspective view of a corner joint construction for a log building according to the present invention.

As best seen in FIG. 1, the log building according to the present invention utilizes a mortise and tenon joint at the corners so that adjoining logs are at the same height. Each of the logs shown has substantially the same cross-sectional configuration throughout a substantial portion of the length but differ from each other at the various types of joints.

Figure 2A:
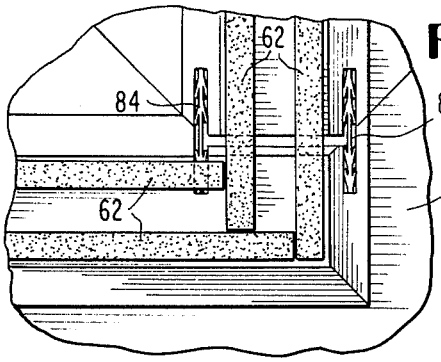
FIG. 2A is a top plan view on an enlarged scale showing a portion of the corner joint.
Figure 2:
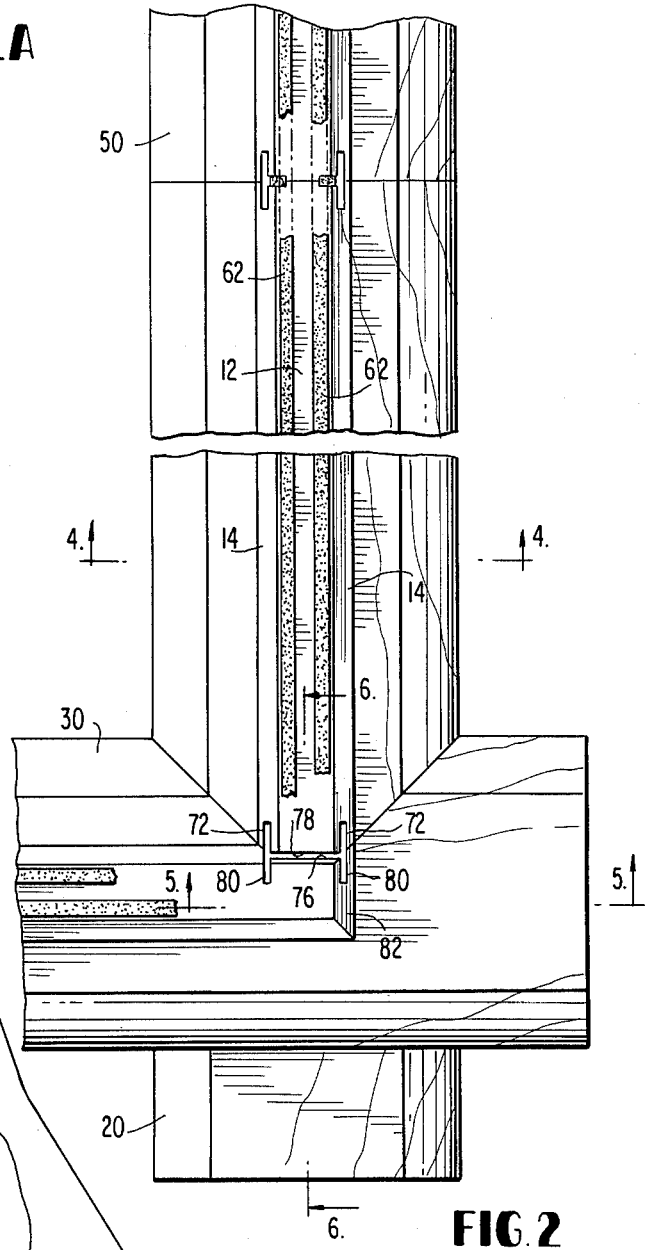
FIG. 2 is a top plan view of a corner joint according to the present invention.

The log 10 as best shown in FIGS. 1, 2 and 4 is provided with a tongue 12 on the upper surface thereof having identically beveled edges 14 which extends the entire length of the log. A rectilinear groove 16 is formed in the bottom surface of the log 10 and extends the entire length thereof. A check groove 18 is located in the bottom of the groove 16 and also extends the entire length of the log for the purpose of relieving tension in the log as it dries to prevent undue warping or twisting.

When the log 10 is placed on the log 20, the tongue and groove arrangement of each log will form a self-aligning weather tight joint as best seen in FIG. 4. The tongue 22 of the log 20 will fit within the groove 16 of the log 10 with relatively close tolerances. The beveled edges 24 on the tongue 22 in combination with the bottom corners of the groove 16 define a pair of elongated expansion chambers 60. A pair of compressable foam gasket strips 62 extend the entire length of the tongue 22 on the upper surface thereof on opposite sides of the check groove 18 in the log 10. The thickness of the gasket strips 62 and the dimensions of the tongue and groove are chosen such that the gasket strips 62 will be partially compressed when the bottom surfaces of the log 10 on opposite sides of the groove 16 rest on the upper surfaces of the log 20 on opposite sides of the tongue 22. The gasket strips may be of any suitable material but preferably comprised of a polyurethane foam material. Since the gasket strips 62 are located on top of the tongue, they are relatively isolated from the weather and the expansion chambers prevent the propagation of drafts which might occur between the mating surfaces of the logs 10 and 20 due to surface irregularities.

At the corner of the log building mortise and tenon joints are formed between intersecting logs in the same course with the mortise and tenon joint being reversed in alternating courses. This arrangement is best seen in FIGS. 1 and 2 wherein the end of the log 10 is beveled at 70 with the edge of the beveled surfaces intersecting the beveled surfaces 14 on the tongue 12. A pair of parallel vertical slots 72 are formed in the end of the log 10 and also intersect the beveled surfaces 14 of the tongue 12 inwardly of the beveled surfaces 70. A complimentary vertical notch is formed in the side of the log 30 at a location spaced from the end of the log 30. The notch is provided with a pair of outwardly flaring side walls 74 against which the beveled surfaces 70 will abut. The bottom surface of the notch 76 intersects the beveled surface 34 on the tongue 32 of the log 30 and will be spaced from the vertical end surface 78 on the log 10 with sufficient clearance to ensure that the beveled surfaces 70 on the log 10 will abut the side walls 74 of the notch in the log 30. A pair of parallel vertically disposed slots 80 extend into the log 30 adjacent the intersections between the walls 74 and 76 of the notch. The slots 80 are in alignment with the slots 72 in the log 10 with one of the slots 80 intersecting the beveled end 82 of the tongue 32. A pair of weather deflector strips 84 are inserted into the slots 72 and 80 as best seen in FIG. 2A thereby completely sealing the vertical portion of the joint between the logs 10 and 30. The weather deflector strips are constructed of plastic material and include a plurality of oppositely directed flaps which will be compressed upon insertion of the weather deflector strip into the slots to ensure a tight joint and to prevent the lateral withdrawal of the weather deflector strips from the slots should any shrinkage occur in the logs at the joint. As best seen in FIGS. 2 and 2A, the beveled end surface 82 of the tongue 32 of the log 30 is aligned with the outer beveled surface 14 of the tongue 12 on the log 10. The inner beveled surface 14 of the tongue 12 intersects the beveled surface 34 on the tongue 32 of the log 30. In this way, any moisture which gathers on the surfaces of the weather deflector strips 84 will drain downwardly on the beveled surfaces of the tongue away from the joint. Thus, by having the corner joint located within the vicinity of the raised tongue on each log, additional weather protection will be provided. The gasket strips 62 on the upper surface of the tongue 12 on the log 10 will abut the gasket strips 62 on the upper surface of the tongue 32 of the log 30 as best seen in FIG. 2A to complete the sealing of the weatherproof corner joint. The corner joint between the logs 20 and 40 is identical to the corner joints between the logs 10 and 30 but is reversed so that alternate logs on each wall will protrude beyond the corner of the building.

Since the ends of the logs 20 and 30 are exposed to the weather, it would conceivably be possible for drafts, moisture, insects and dirt to infiltrate along the check grooves 28 and 38. Thus, a weather stop in the form of a corrugated metal strip 86 is driven into the bottom of each log whose end is exposed to completely block off the check groove in that log adjacent the corner joint. As best seen in FIG. 5 a corrugated metal strip 86 is driven into the bottom of a log 90 to completely block the check groove 98 in the bottom of that log. The log 90 would be the log resting on top of the joint formed between the logs 10 and 30 as viewed in FIG. 2. The metal strip 86 is spaced inwardly from the end of the log 90 a sufficient distance so as to be aligned with and disposed in engagement with the gasket strip 62 on the upper surface of the tongue 32 of the log 30. Thus, drafts, moisture, insects and dirt are prevented from entering the check groove 98 of the log 90 past the corner joint.

Figure 3:
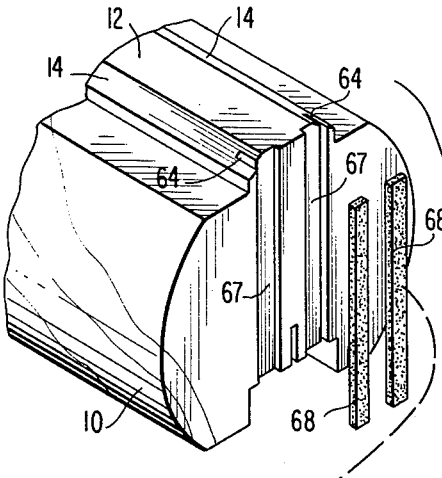
FIG. 3 is an exploded view of a butt joint for the log building construction according to the present invention.
Figure 3:
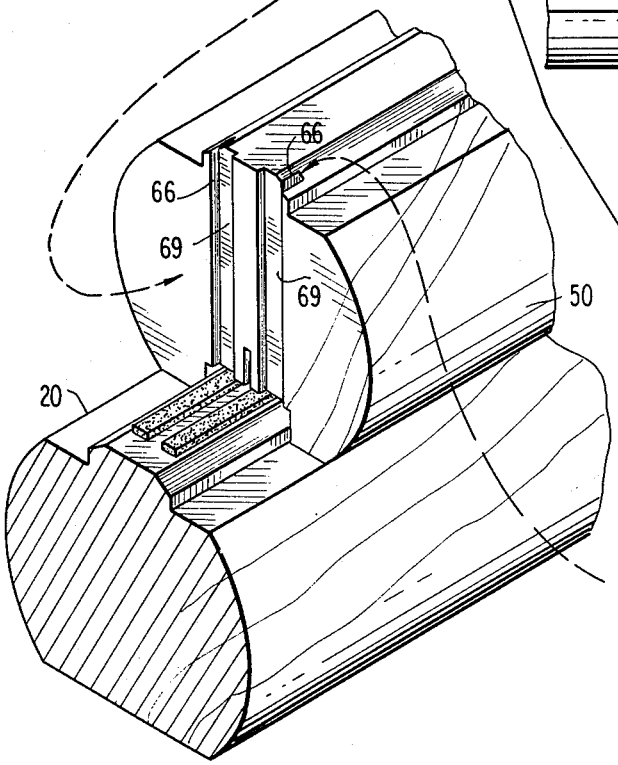
Figure 3:
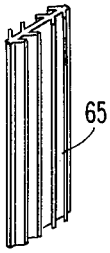

Butt joints between logs are constructed as shown in FIGS. 2 and 3. The end of the log 10 is provided with a pair of parallel vertically disposed slots 64 which intersect the beveled surfaces 14 of the tongue 12. Similar slots 66 are formed in the end of the log 50 in alignment with the slots 64 and a pair of weather deflectors 65 similar to the weather deflectors 84 are disposed in the slots 64 and 66. A pair of parallel vertically disposed recesses 67 are formed in the end of the log 10 inwardly of the slots 64 and a pair of similar recesses 69 are formed in the end of the log 50 inwardly of the slots 66. The depth of each of the slots 67 and 69 is less than half the thickness of the compressible gasket strips 68 which are disposed in the mating recesses so that the gasket strips 68 will be compressed to some degree when the ends of the logs 10 and 50 abut each other. The gasket strips 68 are similar to the gasket strips 62 and are located in the recesses 67 and 69 so as not to interfere with the abutment of the ends of the logs 10 and 50.

The foregoing butt joint construction can also be used to join the butt ends of logs to window or door frames or to join window or door frames to each other. Such door or window frames would have grooves in them identical to the grooves in the butt ends of the logs. The weather deflector strips would be continuous along the height of the window or door frame and would deflect the weather outside of the primary seal.

The joint constructions described above provide a weather tight and self-aligning log building system that can be used with manufactured or pre-cut logs. All of the vertical joints are protected by weather deflector strips to direct any infiltrating water away from the primary seal between the logs which is achieved by the compressible foam gasket strips. While the preferred material for the gasket strips is a closed cell polyurethane foam material a rubber or predominately closed cell polyvinylchloride foam material may be used. Prior to placing the foam strips 62 on top of the logs as viewed in FIG. 2A, a bead of caulking could be applied to the top of each weather deflector strip 65 and 84 and the space between the walls 76 and 78 to prevent any moisture or air from entering these areas. The foam strips could also be continuous at the corners to provide an even more complete seal for the corner joint.

The compressible foam strips are also protected along the horizontal surfaces by virtue of their location on the top of the tongue of each log. The provision of the tongue and groove construction coupled with the expansion chambers protect the primary seal from direct exposure to strong winds which could otherwise force air or driving rain around or through the gasket. The elimination of grooves from the upper surfaces of the logs eliminates a means by which water or air can propagate within the walls thereby affording trapped water or air access to entry points to the inside of the building somewhere along the walls.

The system can use logs or timbers of non-uniform outer diameter which are machined to a uniform height although it is preferred to utilize uniform diameter logs or timbers so that consistent overhang and drip edge can be machined into the logs. The logs can be rounded on the inside and outside as illustrated or can be flat on the inside and outside or a combination thereof.

While the invention has been particularly shown and described with reference to a preferred embodiment thereof, it will be understood by those in the art that various changes in form and details may be made without departing from the spirit and scope of the invention.

What is claimed is:

1. A log building construction comprising a plurality of courses of logs, each log of solid wood having a tongue on the upper surface and a rectilinear groove in the bottom surface interfitted with the groove and tongue respectively of adjacent logs, said tongue having beveled side edges to define with the corners of said rectilinear groove a pair of elongaged expansion chambers for preventing the propagation of drafts, a check groove in the bottom of said rectilinear groove and compressible gasket means on the upper surface of each tongue on opposite sides of said check groove engaging the bottom surface of the rectilinear groove.

2. A log building construction as set forth in claim 1, further comprising a butt joint for logs in the same course comprising a pair of vertical parallel slots in the end of one of said logs intersecting the beveled edges of the tongue thereon, a pair of vertical parallel recesses formed in the end of said one of said logs inwardly of said slots, a pair of complimentary slots and a pair of complimentary recesses formed in the end of the other log, a pair of weather deflector strips disposed in said two pairs of slots and a pair of compressible gasket strips disposed in said two pairs of recesses, the combined depth of said two pairs of recesses being less than the thickness of said gasket strips so that said gasket strips will be compressed without preventing the ends of said logs from abutting each other.

3. A log building construction as set forth in claim 2, wherein said weather deflector strips are each comprised of a flat strip of elastomeric material having a plurality of integral flaps extending outwardly from each side thereof at an acute angle relative to said flat strip, the flaps adjacent each edge of said weather deflector strip being angled toward the flaps adjacent the opposite edge of the strip.

4. A log building construction comprising a plurality of courses of logs, each log having a tongue on the upper surface and a rectilinear groove in the bottom surface interfitted with the groove and tongue respectively of adjacent logs, said tongue having beveled side edges to define with the corners of said rectilinear groove a pair of elongated expansion chambers for preventing the propagation of drafts and compressible gasket means on the upper surface of each tongue engaging the bottom surface of the rectilinear groove, wherein two logs in the same course engage each other at right angles, the side end edges of one of said two logs being cut off adjacent the end thereof to define a tenon, a first pair of parallel vertical slots disposed in the end of the log intersecting the beveled edges of the tongue, a mortise formed in the side of the other of said two logs having a configuration complementary to said tenon, a bottom wall of said mortise extending parallel to and adjacent the beveled edge of the tongue thereon, a second pair of parallel vertical slots disposed in the other of said two logs in said bottom wall in alignment with said first pair of slots and a pair of vertically disposed weather deflector strips disposed in said aligned first and second slots.

5. A log building construction as set forth in claim 4, wherein said weather deflector strips are each comprised of a flat strip of elastomeric material having a plurality of integral flaps extending outwardly from each side thereof at an acute angle relative to said flat strip, the flaps adjacent each edge of said weather deflector strip being angled toward the flaps adjacent the opposite edge of the strip.

6. A log building construction as set forth in claim 4, further comprising a check groove disposed in the bottom of each rectilinear groove extending the length of the log, stop means blocking said check groove at each corner joint at a location in alignment with the gasket strip on the upper surface of the associated tongue to prevent passage of air, moisture and foreign material past the corner joint.

7. A log building construction as set forth in claim 6, wherein said stop means is comprised of a corrugated metal strip driven into the bottom of said rectilinear groove to intersect and completely block said check groove.

* * * * *